US005936996A

United States Patent [19]

Eidem et al.

[11] Patent Number: 5,936,996

[45] Date of Patent: Aug. 10, 1999

[54] FURNACE PLANT

[75] Inventors: Magnus Eidem, Skultuna; Per Henriksson, Vasteras; Lars Karlsson, Vasteras; Lars Nordekvist, Vasteras; Petter Oscarsson, Vasteras; Gunnar Sellberg, Vasteras; Gote Tallback, Ba, all of Sweden

[73] Assignee: Asea Brown Boveri AB, Vasteras, Sweden

[21] Appl. No.: 08/945,188

[22] PCT Filed: Apr. 24, 1996

[86] PCT No.: PCT/SE96/00543

§ 371 Date: Jan. 6, 1998

§ 102(e) Date: Jan. 6, 1998

[87] PCT Pub. No.: WO96/34244

PCT Pub. Date: Oct. 31, 1996

[30] Foreign Application Priority Data

Apr. 25, 1995 [SE] Sweden ..... 9501562

[51] Int. Cl.[6] ..... F27D 23/04

[52] U.S. Cl. ..... 373/85; 373/4; 373/64

[58] Field of Search ..... 373/76, 138, 139, 373/154, 157, 158, 156, 22, 64, 85, 4; 266/89, 91, 94, 208, 233; 75/678, 708, 10.65; 428/377; 164/504, 468

[56] References Cited

U.S. PATENT DOCUMENTS

| | | | |
|---|---|---|---|
| 2,652,440 | 9/1953 | Simmons | 373/64 |
| 3,683,094 | 8/1972 | Schlienger | 373/85 |
| 4,294,435 | 10/1981 | Matsuno | 266/234 |
| 4,406,321 | 9/1983 | Fujiwara et al. | 164/504 |
| 4,578,794 | 3/1986 | Cdek | 373/42 |
| 4,581,745 | 4/1986 | Mathews et al. | 373/107 |
| 4,706,735 | 11/1987 | Mizota et al. | 164/504 |
| 4,778,518 | 10/1988 | Bergman et al. | 75/10.16 |
| 4,820,342 | 4/1989 | Ekander et al. | 373/4 |

FOREIGN PATENT DOCUMENTS

| | | |
|---|---|---|
| 2 672 620 A1 | of 1992 | France . |
| WO 90/03544 | of 1990 | WIPO . |
| WO 94/03294 | of 1994 | WIPO . |

OTHER PUBLICATIONS

Patent Abstracts of Japan, vol. 9, No. 237, C–305, Abstract of JP, A, 60–96735 (Kawasaki Seitetsu K.K.). 1985.

Asea Tidning, vol. 63, No. 2, 1971, Yngve Sundberg, De induktiva omrörarnas princip och funktion, pp. 23–24.

*Primary Examiner*—Tu Ba Hoang

*Attorney, Agent, or Firm*—Pollock, Vande Sande & Amernick

[57] ABSTRACT

A furnace plant which at least one furnace vessel with side walls and a bottom and at least one heat source which by radiation and convection heats molten metal and/or solid metal present in the furnace vessel. At least one two- or multiphase electromagnetic side stirrer is arranged in or near the wall of the furnace vessel to act through the wall and apply a stirrer field to the molten metal. The side stirrer comprises at least two phase windings arranged around an iron core having a vertical extent, H, which essentially covers the region, $D_{max}$, between the bottom and the upper surface of the molten metal at a maximum bath depth used in the furnace 15 vessel. The side stirrer is arranged with a pole pitchτ which exceeds twice the distance from the iron core to the molten metal, τ>2 dw.

9 Claims, 3 Drawing Sheets

FURNACE PLANT

TECHNICAL FIELD

The present invention relates to a furnace plant for melting metal and/or holding molten metal which at least comprises:

- at least one furnace vessel with walls and a bottom intended for molten metal and/or solid metal,
- at least one heat source which by convection and radiation heats molten and solid metal present in the furnace vessel, and
- electromagnetic means adapted to stir molten metal present in the furnace vessel.

The invention preferably relates to a furnace plant for melting and/or holding aluminium which at least comprises:

- a furnace chamber with at least one furnace vessel, intended for molten and/or solid aluminium, with walls and a bottom and at least one furnace roof arranged over the furnace vessel,
- at least one heat source which is arranged in or near the furnace roof and which by convection and radiation heats aluminium present in the furnace vessel, and
- electromagnetic means adapted to stir molten metal present in the furnace vessel.

BACKGROUND OF THE INVENTION

During melting and/or holding of aluminium, it is known to use electromagnetic stirrers placed below the furnace vessel to obtain a stirring of the molten metal in the furnace vessel and to reduce the temperature and the concentration gradients in the molten metal and to increase the productivity of the furnace plant. Especially, it is desired to reduce overtemperatures at the upper surface of the molten metal. Overtemperature in this patent application is meant the temperature difference which prevails between the maximum temperature to which any part of the molten metal is heated during the melting or holding and the melting temperature of the molten metal. A great overtemperature often leads to metal losses by oxidation and formation of dross and slag. At the same time, the energy utilization of the process is negatively influenced. Metal losses and a low energy efficiency are a problem in so-called reverberatory furnaces where oil and gas burners heat the metal by convection and radiation.

By stirring the molten metal, the temperature and concentration gradients in the molten metal are equalized so that overtemperatures may be reduced and the energy efficiency of the process be improved. This can be illustrated in that, during electromagnetic stirring, the effective coefficient of heat conduction in the molten metal is increased more than 10 times compared with the coefficient of heat conduction in a non-stirred melt. By effective coefficient of heat conduction in this patent application is meant the coefficient of heat conduction which describes the heat transport in the melt bath taking into consideration both the conductive heat flux in the molten metal and/or the solid metal and the extra contribution in the form of the convective heat flux which is obtained in the molten metal through the stirring.

It is known to arrange, in furnace plants for melting and holding of aluminium, electromagnetic stirrers below the furnace for achieving a bottom stirring, for example from U.S. Pat. No. 4,294,435. Typically, this gives an increase of the effective coefficient of heat conduction by a factor of 25–35. However, in certain cases, economic and constructive complications arise when it is desired to arrange bottom stirrers below furnaces or near the furnace bottom according to the prior art. This is particularly noticeable in those cases where it is intended to install stirrers in existing furnace plants to increase the energy efficiency and productivity of the furnace and to reduce the temperature and concentration gradients in the molten metal. In addition, such a supplementary installation of bottom stirrers in an existing furnace plant is, in many cases, rendered difficult by the fact that the furnace is standing on a floor and that its bottom is not, without extensive rebuilding of the furnace hall, available for such an installation. It is known to arrange electromagnetic means in or near the walls which separate different melt baths in a melting furnace in order to achieve a stirring of the molten metal by pumping molten metal between the different baths. In similar manner, a stirring can be obtained by allowing electromagnetic means to act on a channel which is arranged in or near the walls of the furnace vessel and which communicates, at both ends, with the molten metal present in the furnace vessel. Further, U.S. Pat. No. 4,294,435 discloses that it would be desirable, in a furnace plant for melting and holding aluminium, to arrange electromagnetic means near the electromagnetic means arranged in the furnace walls, so-called side stirrers, which act through the wall and apply a magnetic stirrer field to the molten metal present in the furnace vessel in order to achieve a side stirring. However, it is not stated how side stirrers are to be designed or arranged to achieve an efficient stirring of the molten metal present in the furnace vessel when the furnace vessel has a large bath surface in relation to its bath depth.

Based on constructive and economic aspects, it is desirable, as stated above, to arrange electromagnetic stirrers to act through the side walls of the furnace, side stirrers, to achieve a side stirring. However, stirring by means of side stirrers which are placed in or near the wall of the furnace vessel has been considered to provide insufficient stirring in a furnace vessel, especially in a furnace vessel with a large bath surface in relation to its bath depth.

One object of the invention is to suggest a furnace plant which comprises at least one two- or multiphase electromagnetic stirrer, designed and arranged according to the invention to achieve an efficient side stirring in a furnace vessel with a large bath surface in relation to its bath depth, whereby the effective coefficient of heat conduction of the molten metal is increased by a factor of 10 or more, thus reducing the temperature and concentration gradients and increasing the productivity and energy efficiency of the furnace plant.

SUMMARY OF THE INVENTION

An efficient side stirring is achieved in a furnace plant for melting of metal and/or holding of molten metal which at least comprises:

- at least one furnace vessel, intended for molten metal and solid metal, with side walls and a bottom, preferably a furnace vessel with a large bath surface relative to its bath depth,
- at least one heater which by radiation and convection heats molten metal and/or solid metal present in the furnace vessel,
- at least one two- or multiphase electromagnetic side stirrer arranged in or near the wall of the furnace vessel to act through this wall and apply a magnetic travelling alternating field to the molten metal, a magnetic stirrer field to stir molten metal present in the furnace vessel.

The side stirrer comprises at least two phase windings arranged near an iron core. According to the invention, the iron core is arranged with a vertical extension which essentially covers the molten metal, that is, the region between the bottom and the upper surface of the molten metal at a maximum bath depth in the furnace vessel. Further, the iron core is arranged with a pole pitch $\tau$ which exceeds twice the distance from the iron core to the molten metal, $\tau > 2\ d_w$.

By a maximum bath depth is meant the maximum bath depth which, under normal operating conditions, is used in the furnace plant. Normally, the maximum bath depth in a furnace for melting and/or holding aluminium is below 1 meter in known furnaces; most often, the maximum bath depth for this type of furnaces varies within the interval 0.3 to 0.9 meters.

Electric currents flow through the side stirrer and generate an electromagnetic field in the molten metal which tends to create vertically directed electric currents in the molten metal. These electric currents deflect at the upper surface of the molten metal and at the bottom of the furnace vessel. To attain the desired effective stirring, the iron core in the above-mentioned side stirrer is arranged with a vertical extent which exceeds the distance from the iron core to the molten metal, which in furnaces for melting and/or holding aluminium often amounts to between 0.5 and 1 meter. In one embodiment of the invention, the iron core is arranged with a vertical extent which amounts to between 1 and 3 times this distance, preferably between 1.5 and 3 times this distance. The distance between the iron core and the molten metal is determined by the thickness of the lining and is thus established by parameters which are not influenced by the present invention, such as the properties of the molten metal and the choice of lining material.

According to one embodiment of the invention, a side stirrer included in the furnace plant is arranged with a pole pitch within the distance interval of 2.5 to 5 times the distance from the iron core to the molten metal.

To further increase the stirring capacity, in certain embodiments of the invention the side stirrer is adapted to apply to the molten metal a magnetic stirrer field with a frequency of 0.2 to 2.0 Hz, preferably with a frequency of 0.4 to 1.6 Hz.

According to another embodiment of the invention, a side stirrer included in the furnace plant is adapted to apply to the molten metal a periodically reversed stirrer field. Since flow in a molten metal is a relatively inert phenomenon, a periodically recurring reversal results in an additional increase of the stirring capacity. The greatest capacity is attained when the side stirrer is adapted to change the intensity and direction of the applied stirrer field so that the stirring direction is reversed after essentially the period which is required to impart a maximum rotary speed to the molten metal in one direction. The length of such a period between the reversals may be predetermined on the basis of quantities known for each furnace plant, such as the geometry of the furnace vessel, the mass of the molten metal, and the properties of the magnetic field.

To apply to the molten metal a magnetic stirrer field with a good yield by means of side stirrers, the wall of the furnace vessel adjacent the side stirrers is preferably arranged so that at least those magnetic field-strength components in the applied stirrer field, which gives rise to the desired stirring in the molten metal, may pass through the wall with small losses and little damping. In one embodiment of the invention, this has been achieved by providing the wall of the furnace vessel adjacent the side stirrers in a non-magnetic material. Preferably, this has been achieved by arranging a window of the metallic casing of the furnace vessel, adjacent to one side stirrer, in a stainless steel. Another embodiment is especially useful in a furnace plant where, for various reasons, it is desired to avoid rebuilding the walls of the furnace vessel in spite of the fact that these walls comprise a layer of a magnetic material. Those magnetic field-strength components in the stirrer field applied to the molten metal by the side stirrers, which give rise to the desired stirring in the molten metal, may in this embodiment pass through the wall with small losses and little damping by providing at least one coil, supplied by direct current, or at least one permanent magnet to apply a magnetic direct field to act on the layer of magnetic material in the wall. In this way, an anisotropically

BRIEF DESCRIPTION OF THE DRAWINGS

In the following the invention will be explained in greater detail and be exemplified by means of a preferred embodiment of a number of furnace geometries with reference to the accompanying figures.

DETAILED DESCRIPTION OF THE PREFERRED EMBODIMENTS

Figure 1:
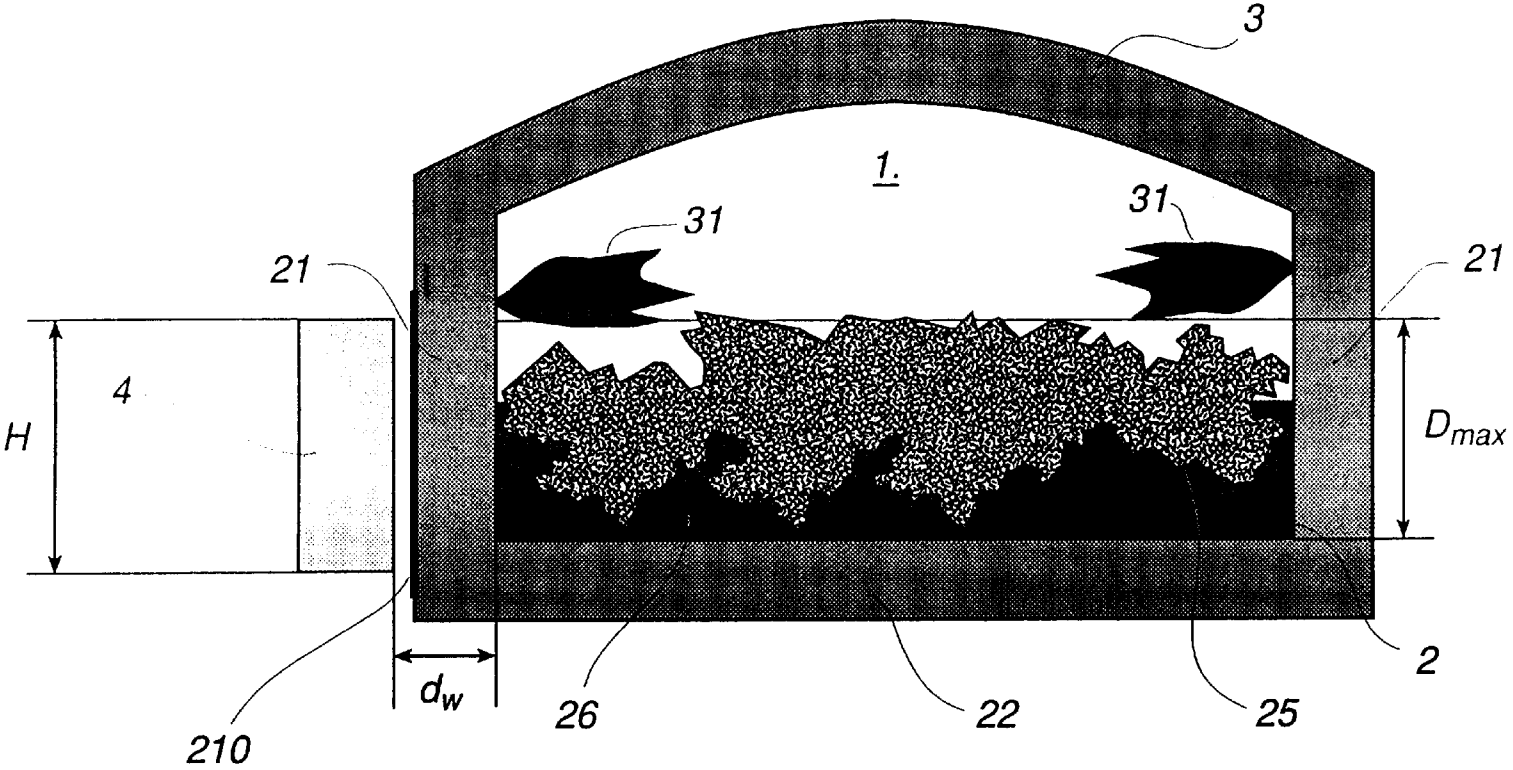
FIG. 1 shows a vertical cross section of a furnace to illustrate the basic principle of the invention.
Figure 2A:
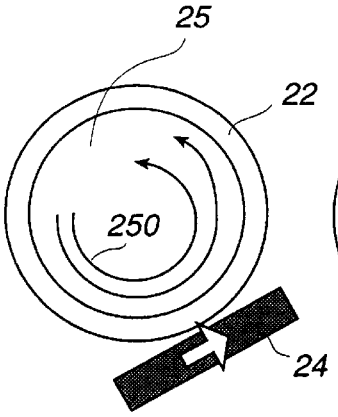
FIGS. 2*a*, 2*b* and 2*c* show horizontal cross sections of furnaces according to the invention with essentially circular furnace vessels.
Figure 2B:
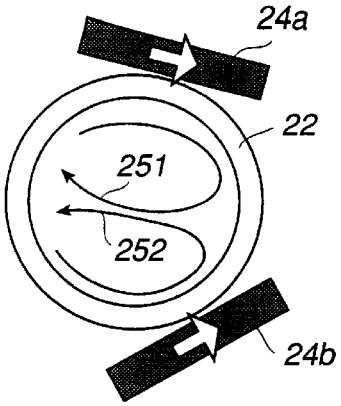
Figure 2C:
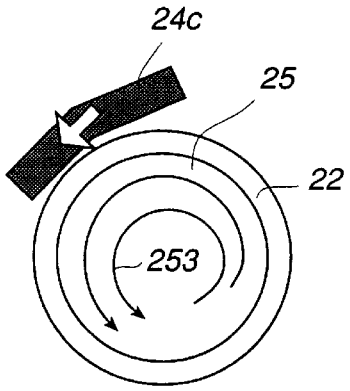
Figure 3A:
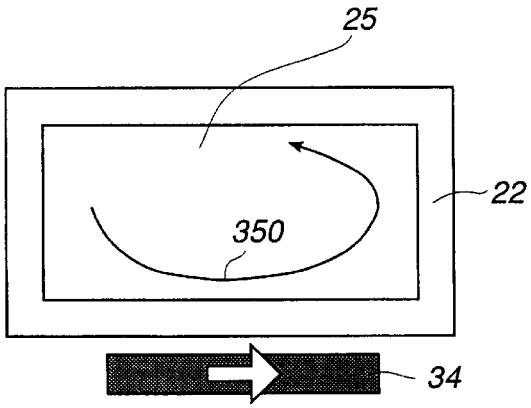
FIGS. 3*a* and 3*b* show horizontal cross sections of furnaces according to the invention with essentially rectangular furnace vessels.
Figure 3B:
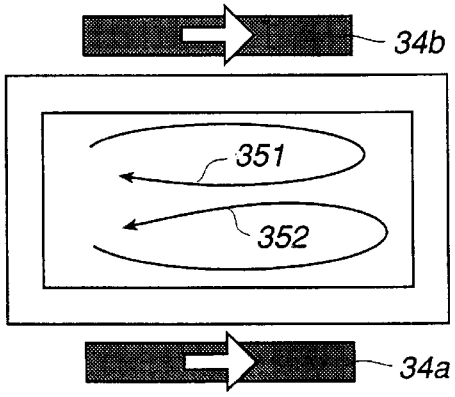
Figure 4:
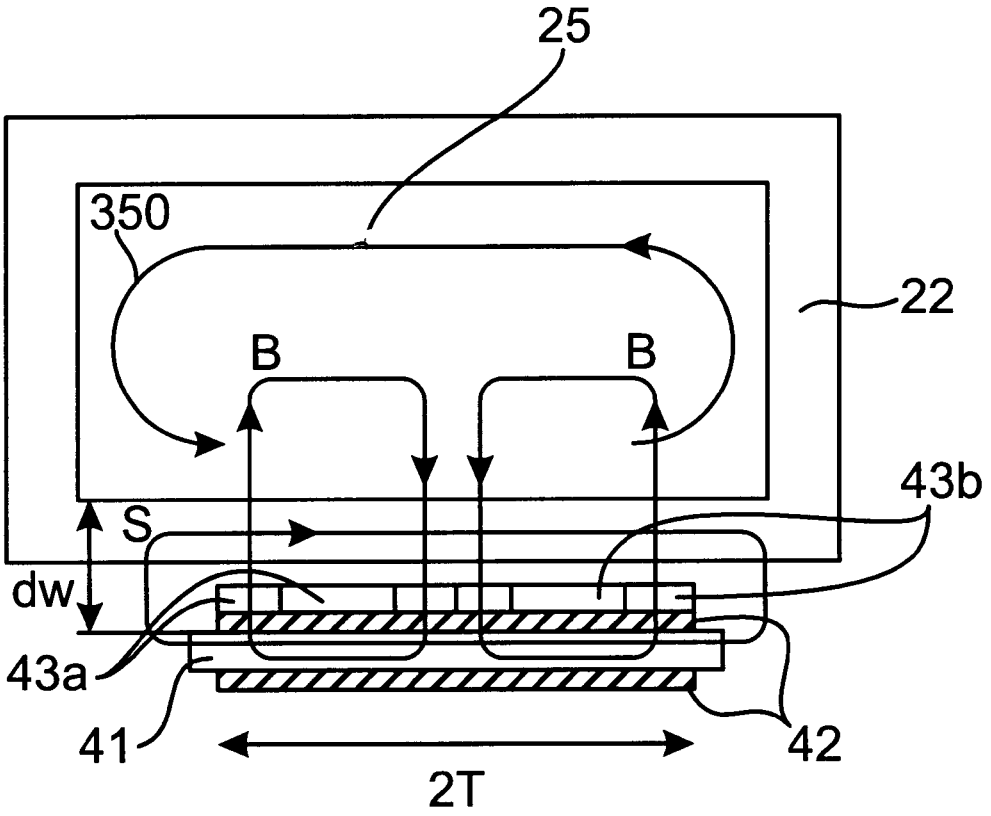
FIG. 4 shows a horizontal cross-section of a furnace, according to the invention with a two phase stirrer.

FIG. 1 shows a furnace chamber 1 in a furnace plant according to a preferred embodiment of the invention. The furnace chamber 1 comprises a furnace vessel 2 which is adapted to be filled with molten metal 25 and/or solid metal 26 and comprises side walls 21 and a bottom 22. Above the molten metal, there is a furnace roof 3 and in or near this roof 3 there are burners 31 which are adapted to heat molten metal 25 and/or solid metal 26, present in the furnace vessel, by radiation and convection. The choice of heat source is of no significance for the present invention and, of course, other types of heat sources, such as electric resistor elements, may be used in cases a sufficient heating capacity can be achieved by such means. At least one two- or multiphase electromagnetic side stirrer 4 is arranged near the wall 21 of the furnace vessel to act through the wall 21 and apply to the molten metal a magnetic stirrer field. The side stirrer 4 comprises at least two phase windings 43*a, b* arranged near an iron core 41, as shown in FIG. 4, the coils 42 are supplied with a DC current. The iron core has a vertical extent, height H, which essentially covers the molten metal, that is, covers the region between the bottom 22 and the upper surface of the molten metal, at the maximum bath depth $D_{max}$ in the furnace vessel. By a maximum bath depth $D_{max}$ is meant the maximum bath depth which, under normal operating conditions, is used in the furnace plant. Normally, the maximum bath depth in a furnace for melting and holding of aluminium is below 1 meter; most often, the maximum bath depth $D_{max}$ for this type of furnaces varies between 0.3 and 0.9 meters.

Electric currents flow through the side stirrer 4 and generate an electromagnetic field in the molten metal 25 which strive to create vertically directed electric currents in the molten metal. These electric currents deflect at the upper surface of the molten metal and at the bottom of the furnace vessel. To achieve the effective stirring situations illustrated by the circulation flows 250, 251, 252, 253, 350, 351, 352 in FIGS. 2*a*, 2*b*, 2*c*, 3*a* and 3*b*, the iron cores in the side stirrers used, 4, 24, 24*a*, 24*b*, 24*c*, 34, 34*a* and 34*b*, are arranged with a vertical extent H which exceeds the distance from the iron core to the molten metal, $d_w$. In one embodiment of the invention, H amounts to between 1 and 3 times $d_w$, preferably 1.5–3 times $d_w$. The distance between the iron core and the molten metal, $d_w$, is determined, among other things, by the thickness of the lining and is thus established by parameters which are not influenced by the present invention, such as the properties of the molten metal and the choice of lining material. To obtain a more efficient stirring in the molten metal, according to one embodiment of the invention, the side stirrers used, 4, 24, 24*a*, 24*b*, 24*c*, 34, 34*a* and 34*b*, are arranged with a pole pitch $\tau$ which exceeds 2 $d_w$, preferably a pole pitch $\tau$ within the distance interval 2.5 $d_w$ to 5 $d_w$. The side stirrers 4, 24, 24*a*, 24*b*, 24*c*, 34, 34*a*, and 34*b* are arranged straight, angled, or curved and they may be adapted to the outer shape of the furnace vessel, to minimize the distance between the iron core and the molten metal, $d_w$.

To further increase the stirring capacity, the side stirrers used, 4, 24, 24*a*, 24*b*, 24*c*, 34, 34*a* and 34*b*, are adapted in certain embodiments to apply to the molten metal a magnetic stirrer field with a frequency of 0.2–2.0 Hz. In a preferred embodiment, a stirrer field with a frequency of 0.4–1.6 Hz is applied to the molten metal.

To further increase the efficiency of the stirring and since flow in a molten metal 25 is a relatively inert phenomenon, the side stirrers used 4, 24, 24*a*, 24*b*, 24*c*, 34, 34*a* and 34*b* are advantageously adapted to periodically reverse the applied stirrer field and the stirring thus obtained, 250, 251, 252, 253, 350, 351, 352. The greatest capacity is achieved when a side stirrer 4, 24, 24*a*, 24*b*, 24*c*, 34, 34*a* and 34*b* is adapted to change the intensity and direction of the applied stirrer field such that the direction of the stirring 4, 24, 24*a*, 24*b*, 24*c*, 34, 34*a* and 34*b* is reversed at essentially the same moment as the molten metal reaches the maximum speed of rotation in one direction. In practice, the reversal is suitably achieved by changing the stirring direction after the period which is required to impart to the molten metal 25 the maximum speed of rotation in one direction. The duration of such a period between the reversals may be predetermined on the basis of quantities known to the furnace plant, such as the geometry of the furnace vessel, the mass of the molten metal, and the properties of the magnetic field.

In order to apply a magnetic stirrer field to the molten metal 25 with a good yield, the wall 21 of the furnace vessel near a side stirrer 4, 24, 24*a*, 24*b*, 24*c*, 34, 34*a* and 34*b* is arranged so that at least those magnetic field-strength components in the applied stirrer field, which give rise to a desired stirring in the molten metal 25, may pass through the wall 21 with small losses and little damping. In one embodiment of the invention, this is achieved by providing the wall 21 of the furnace vessel near a side stirrer 4, 24, 24*a*, 24*b*, 24*c*, 34, 34*a* and 34*b* in a non-magnetic material 210. In the furnace plant shown in FIG. 1, this is achieved by providing a window 210 in a non-magnetic stainless steel in the metallic shell of the furnace vessel, adjacent to a side stirrer 4, 24, 24*a*, 24*b*, 24*c*, 34, 34*a* and 34*b*.

In this way, an anisotropically directed magnetic saturation is achieved in part of the mentioned wall, in a direction, the saturation direction S, which is substantially oriented in the plane of the wall and directed essentially parallel to the desired stirrer direction. A low-frequency magnetic stirrer field comprising magnetic field-strength components, oriented in a plane parallel to the above-mentioned saturation direction and perpendicular to the plane of the wall, may thus pass through the saturated part of the wall with small losses and little damping and generate a stirrer field in the molten metal in the form of a magnetic alternating field with components directed essentially parallel to and perpendicular to the saturation direction.

We claim:

1. A furnace plant comprising:

at least one furnace vessel for molten metal and solid metal, said vessel having side walls and a bottom;

at least one heater which by radiation and convection heats at least one of 1) molten metal and 2) solid metal present in said furnace vessel;

at least one electromagnetic side stirrer having at least two phases arranged near the side walls of the furnace vessel to act there through and apply a stirrer field to the molten metal present in the furnace vessel;

the electromagnetic side stirrer comprising at least two-phase windings arranged around an iron core, the iron core being arranged with a vertical extent, H, which essentially covers a region, $D_{max}$, between the bottom and an upper surface of the molten metal at a maximum bath depth used in the furnace vessel, and wherein the side stirrer is arranged with a pole pitch $\tau$ which exceeds twice a distance dw from the iron core to the molten metal, $\tau>2$ dw.

2. A furnace plant according to claim 1, wherein said iron core has a vertical extent, H, which amounts to 1 to 3 times the distance dw from the iron core to the molten metal, dw<H<3 dw.

3. A furnace plant according to claim 1 wherein said at least one side stirrer is arranged with a pole pitch $\tau$ within an interval of 2.5 to 5 times the distance dw from the iron core to the molten metal, 2.5 dw<$\tau$<5 dw.

4. A furnace plant according to claim 1 wherein said at least one side stirrer is adapted to apply to the molten metal a magnetic stirrer field, a magnetic alternating field, with a frequency of 0.25 to 2.0 Hz.

5. A furnace plant according to claim 1 wherein said at least one side stirrer is adapted to apply to the molten metal a periodically reversed magnetic stirrer field.

6. A furnace plant according to claim 1 wherein the walls of the furnace vessel near said at least one side stirrer are arranged such that at least those magnetic field-strength components in the stirrer field applied to the molten metal by said at least one side stirrer, which give a predetermined circulation in the molten metal, pass through the wall.

7. A furnace plant according to claim 6, wherein the walls of the furnace vessel near said at least one side stirrer are arranged in a non-magnetic material.

8. A furnace plant according to claim 6, wherein the side walls of the furnace vessel comprise a layer of a magnetic material and at least one coil, supplied with direct current, adapted to apply a magnetic direct field to act on the magnetic material in the side wall and to achieve an anisotropically directed magnetic saturation in part of said side wall, in a saturation direction, which is substantially oriented in a plane of the wall and directed essentially parallel to a predetermined stirrer direction, whereby a low-frequency magnetic travelling alternating field, comprising magnetic field-strength components oriented in a plane parallel to said saturation direction and perpendicular to the plane of the wall, passes through the part of the side wall with said anisotropically directed magnetic saturation and generates a stirrer field in the molten metal in the form of a magnetic alternating field with components directed essentially parallel to and perpendicular to said saturation direction.

9. A furnace plant according to claim 6, wherein the side walls of the furnace vessel comprise a layer of a magnetic material and at least one permanent magnet, adapted to apply a magnetic direct field to act on the magnetic material in the side wall and to achieve an anisotropically directed magnetic saturation in part of said side wall, in a saturation direction, which is substantially oriented in a plane of the wall and directed essentially parallel to a predetermined direction, whereby a low-frequency magnetic travelling alternating field, comprising magnetic field-strength components oriented in a plane parallel to said saturation direction and perpendicular to the plane of the wall, passes through the part of the side wall with anisotropically directed magnetic saturation and generates a stirrer field in the molten metal in the form of a magnetic alternating field with components directed essentially parallel to and perpendicular to said saturation direction.

* * * * *